United States Patent [19]

Teramura et al.

[11] 4,434,111

[45] Feb. 28, 1984

[54] VARIABLE VENTURI-TYPE CARBURETOR

[75] Inventors: Mitsuyoshi Teramura; Masatami Takimoto, both of Toyota; Norihiko Nakamura, Mishima; Takaaki Itou, Mishima; Takashi Katou, Mishima; Takeru Yasuda; Sunao Kitamura, both of Nagoya, all of Japan

[73] Assignees: Toyota Jidosha Kabushiki Kaisha; Aisan Industry Co., Ltd., both of Japan

[21] Appl. No.: 411,281

[22] Filed: Aug. 25, 1982

[30] Foreign Application Priority Data

Feb. 16, 1982 [JP] Japan ..... 57-22051

[51] Int. Cl.[3] ..... F02M 9/06

[52] U.S. Cl. ..... 261/44 C; 261/121 B; 261/DIG. 74

[58] Field of Search ..... 261/44 C, 121 B, DIG. 74

[56] References Cited

U.S. PATENT DOCUMENTS

| | | | |
|---|---|---|---|
| 4,117,046 | 9/1978 | Nohira et al. | 261/44 C |
| 4,167,547 | 9/1979 | Takamura et al. | 261/44 C |
| 4,360,482 | 11/1982 | Asai | 261/44 C |
| 4,393,012 | 7/1983 | Kato et al. | 261/44 C |

FOREIGN PATENT DOCUMENTS

| | | | |
|---|---|---|---|
| 54-50728 | 4/1979 | Japan | 261/44 C |
| 54-132024 | 10/1979 | Japan | 261/44 C |
| 54-142421 | 11/1979 | Japan | 261/44 C |
| 55-87842 | 3/1980 | Japan | 261/44 C |

*Primary Examiner*—Tim R. Miles

*Attorney, Agent, or Firm*—Finnegan, Henderson, Farabow, Garrett & Dunner

[57] ABSTRACT

A variable venturi-type carburetor comprising a vacuum chamber, connected to a venturi portion of the carburetor, and a suction piston actuated in response to a change in vacuum in the vacuum chamber. A fuel passage is formed in the carburetor and is open to the intake passage of the carburetor. The suction piston has a needle extending through the fuel passage. An air bleed passage is connected to the fuel passage. When the level of vacuum in the intake passage becomes smaller than a predetermined level, the amount of air fed into the fuel passage from the air bleed passage is reduced, and the vacuum chamber is caused to be open to the atmosphere.

13 Claims, 2 Drawing Figures

VARIABLE VENTURI-TYPE CARBURETOR

BACKGROUND OF THE INVENTION

The present invention relates to a variable venturi-type carburetor.

A variable venturi-type carburetor comprises a suction piston, projecting into the intake passage of the carburetor, and a compression spring biasing the suction piston toward the intake passage. The suction piston moves so that the difference between the pressure in the intake passage located upstream of the suction piston and the vacuum in the intake passage located downstream of the suction piston becomes equal to a fixed value determined by the spring force of the compression spring. In an engine equipped with such a carburetor, in order to obtain a good combustion when a lean air-fuel mixture is used, it is necessary to promote the atomization of fuel by increasing the velocity of air passing through the tip face of the suction piston. In this regard, if the spring force of the compression spring is strengthened, it is possible to increase the velocity of air passing through the tip face of the suction piston. However, if the spring force of the compression spring is strengthened, when the amount of air fed into the cylinder of the engine is small, as at the time of idling, the flow area of the intake passage becomes excessively small and, thus, the flow resistance of the intake passage becomes large. Thus makes it impossible to feed air into the cylinder of the engine in the amount necessary for the engine idling operation, and thus, makes idling operation impossible.

SUMMARY OF THE INVENTION

An object of the present invention is to provide a variable venturi-type carburetor which is capable of promoting the atomization of fuel by increasing the velocity of air passing through the tip face of the suction piston when the engine is operating under a partial load and which is capable of obtaining a flow area of the intake passage sufficient to ensure good engine operation during idling.

According to the present invention, there is provided a variable venturi-type carburetor comprising: an intake passage formed in said carburetor and having an inner wall; a casing having therein an interior chamber which extends perpendicular to said intake passage; a suction piston movably inserted into said casing and having a tip face which projects into said intake passage and defines a venturi portion, said suction piston dividing the interior chamber of said casing into an atmospheric pressure chamber and a vacuum chamber which is connected to said venturi portion for moving said suction piston in response to a change in the amount of air flowing within said intake passage; a throttle valve arranged in said intake passage located downstream of said suction piston; a fuel passage having a metering jet therein and being open to said intake passage for feeding fuel into said intake passage; a needle fixed onto the tip face of said suction piston and extending through said fuel passage and said metering jet; an air bleed passage having an air inlet and an air outlet which is open to said fuel passage, said air inlet being open to the atmosphere; an air feed passage having an air inlet and an air outlet which is open to said vacuum chamber, said air inlet being open to the atmosphere; first valve means arranged in said air bleed passage for controlling the flow area of said air bleed passage; second valve means arranged in said air feed passage for controlling the fluid connection between said vacuum chamber and the atmosphere; and means controlling said first valve means and said second valve means in response to a change in the level of load of an engine for reducing the flow area of said air bleed passage and shutting off said air feed passage when the level of load of the engine is lower than a predetermined level and for increasing the flow area of said air bleed passage and opening said air feed passage when the level of load of the engine is higher than the predetermined level.

The present invention may be more fully understood from the description of preferred embodiments of the invention set forth below, together with the accompanying drawings.

DESCRIPTION OF PREFERRED EMBODIMENTS

Figure 1:
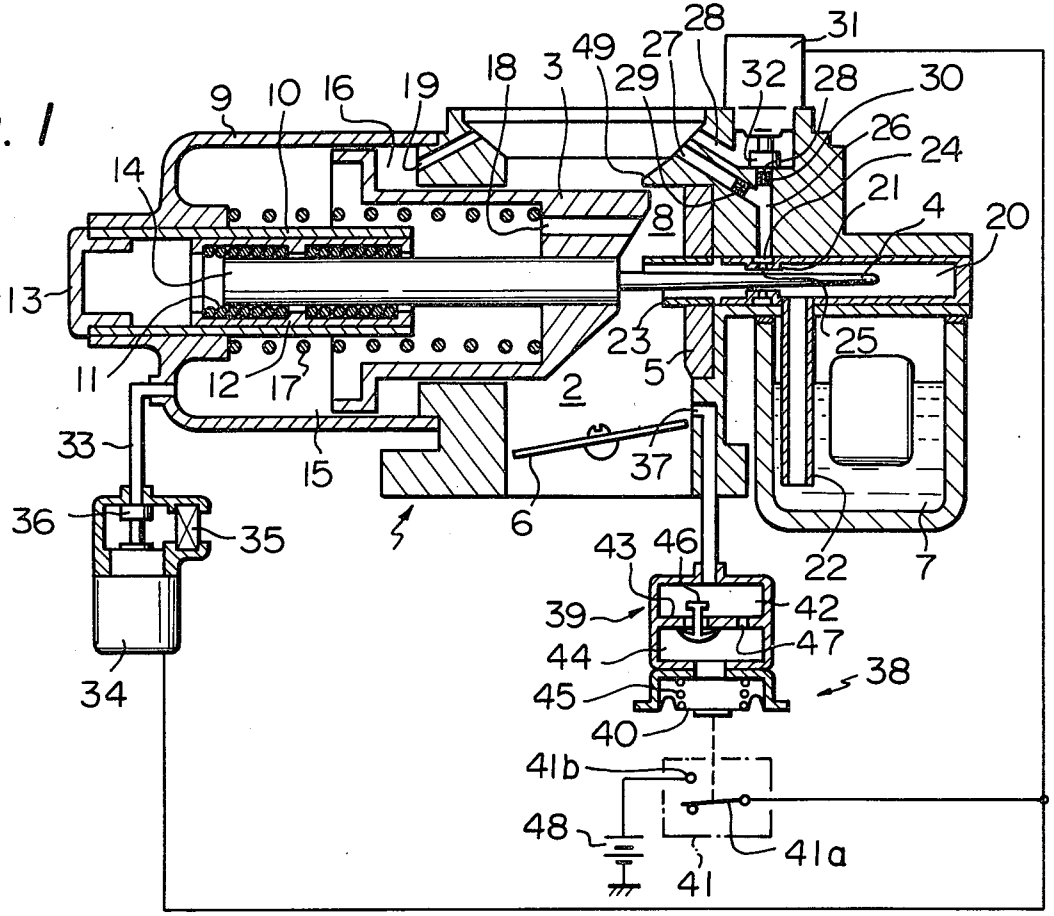
FIG. 1 is a cross-sectional side view of an embodiment of a variable venturi-type carburetor according to the present invention.

Referring to FIG. 1, reference numeral 1 designates a carburetor body, 2 a vertically-extending intake passage, 3 a suction piston transversely movable in the intake passage 2, and 4 a needle fixed onto the tip face of the suction piston 3; 5 designates a spacer fixed onto the inner wall of the intake passage 2 and arranged to face the tip face of the suction piston 3, 6 a throttle valve arranged in the intake passage 2 located downstream of the suction piston 3, and 7 a float chamber of the carburetor. A venturi portion 8 is formed between the spacer 5 and the tip face of the suction piston 3. A hollow cylindrical casing 9 is fixed onto the carburetor body 1, and a guide sleeve 10, extending within the casing 9 in the axial direction of the casing 9, is attached to the casing 9. A bearing 12, equipped with a plurality of balls 11, is inserted into the guide sleeve 10, and the outer end of the guide sleeve 10 is closed with a blind cap 13. On the other hand, a guide rod 14 is fixed onto the suction piston 3 and is inserted into the bearing 12 so as to be movable in the axial direction of the guide rod 14. Since the suction piston 3 is supported by the casing 9 via the bearing 12 as mentioned above, the suction piston 3 is able to smoothly move in the axial direction thereof. The interior of the casing 9 is divided into a vacuum chamber 15 and an atmospheric pressure chamber 16 by the suction piston 3, and a compression spring 17 for continuously biasing the suction piston 3 toward the venturi portion 8 is inserted into the vacuum chamber 15. The vacuum chamber 15 is connected to the venturi portion 8 via a suction hole 18 formed in the suction piston 3, and the atmospheric pressure chamber 16 is connected to the intake passage 2 located upstream of the suction piston 3 via an air hole 19 formed in the carburetor body 1.

A fuel passage 20 is formed in the carburetor body 1 and extends in the axial direction of the needle 4 so that the needle 4 can enter into the fuel passage 20. A metering jet 21 is arranged in the fuel passage 20. The fuel passage 20, located upstream of the metering jet 21, is connected to the float chamber 7 via a downwardly-extending fuel pipe 22, and fuel in the float chamber 7 is fed into the fuel passage 20 via the fuel pipe 22. In addition, a hollow cylindrical nozzle 23, arranged coaxially to the fuel passage 20, is fixed onto the spacer 5. The nozzle 23 projects from the inner wall of the spacer 5 into the venturi portion 8 and, in addition, the upper half of the tip portion of the nozzle 23 projects from the lower half of the tip portion of the nozzle 23 toward the suction piston 3. The needle 4 extends through the interior of the nozzle 23 and the metering jet 21, and fuel is fed into the intake passage 2 from the nozzle 23 after it is metered by an annular gap formed between the needle 4 and the metering jet 21.

An annular air passage 24 is formed around the metering jet 21, and a plurality of air bleed bores 25, connected to the annular air passage 24, is formed on the inner circumferential wall of the metering jet 21. The annular air passage 24 is connected to an upwardly extending air bleed passage 26, and the air bleed passage 26 is divided into a first air bleed passage 27 and a second air bleed passage 28 which are open to the intake passage 2. Air bleed jets 29 and 30 are inserted into the first air bleed passage 27 and the second air bleed passage 28, respectively, and an electromagnetic control valve 31 is arranged in the second air bleed passage 28. The electromagnetic control valve 31 is provided with a valve body 32 for controlling the opening operation of the second air bleed passage 28.

The vacuum chamber 15 is open to the atmosphere via an air conduit 33, an electromagnetic control valve 34, and an air filter 35. The electromagnetic control valve 34 is provided with a valve body 36 for controlling the opening operation of the air conduit 33. A vacuum port 37 is formed on the inner wall of the intake passage 2 at a position located near the throttle valve 6, and the vacuum port 37 is connected to a vacuum switch device 38. The vacuum port 37 is open to the intake passage 2 located upstream of the throttle valve 6 when the throttle valve 6 is in the idling position, as illustrated in FIG. 1, but is open to the intake passage 2 located upstream of the throttle valve 6 when the degree of opening of the throttle valve 6 is increased beyond a predetermined degree. The vacuum switch device 38 comprises a delay valve 39, a diaphragm 40, and a switch 41. The delay valve 39 comprises a first chamber 42 connected to the vacuum port 37, a second chamber 44 separated from the atmosphere by the diaphragm 40 and separated from the first chamber 42 by a partition 43, and a compression spring 45 for biasing the diaphragm 40. A check valve 46, allowing only the inflow of air into the second chamber 44 from the first chamber 42, is arranged on the partition 43, and a restricted opening 47 is formed on the partition 43. The switch 41 comprises a movable contact **41*a* mechanically connected to the diaphragm 40, and a stationary contact 41*b* connected to a power source 48. The movable contact 41*a* is electrically connected to both the electromagnetic control valves 31 and 34**.

As illustrated in FIG. 1, a raised wall 29, projecting horizontally into the intake passage 2, is formed at the upper end of the spacer 5, and a flow control is effected between the raised wall 29 and the tip end portion of the suction piston 3. When the engine is started, air flows downward within the intake passage 2. At this time, since the air flow is restricted between the suction piston 3 and the raised wall 29, vacuum is created in the venturi 8. This vacuum acts on the vacuum chamber 15 via the suction hole 18. The suction piston 3 moves so that the difference between the vacuum in the vacuum chamber 15 and the pressure in the atmospheric pressure chamber 16 becomes approximately equal to a fixed value determined by the spring force of the compression spring 17, that is, the level of the vacuum created in the venturi portion 8 remains approximately constant.

When the throttle valve 6 is in the idling position as illustrated in FIG. 1, the valve body 32 of the electromagnetic control valve 31 shuts off the second air bleed passage 28, and the valve body 36 of the electromagnetic control valve 34 shuts off the air conduit 33. Consequently, at this time, air is bled into the fuel flowing within the metering jet 21 from only the first air bleed passage 27. In addition, at this time, the level of vacuum in the vacuum chamber 15 is equal to that of vacuum in the venturi portion 8. The spring force of the compression spring 17 is so determined that the venturi portion 8 has a flow area which is sufficient for the engine idling operation when the level of vacuum in the vacuum chamber 15 is equal to that of vacuum in the venturi portion 8, as mentioned above.

When the throttle valve 6 remains partially open, since vacuum acts on the second chamber 44 of the vacuum switch device 38, the diaphragm 40 moves upward against the compression spring 45 and, thus, the movable contact **41*a* comes into contact with the stationary contact 41*b*. As a result of this, since both the electromagnetic control valves 31, 34 are energized, the valve body 32 of the electromagnetic control valve 31 opens the second air bleed passage 28, and the valve body 36 of the electromagnetic control valve 34 opens the air conduit 33. Consequently, at this time, since air is bled into fuel flowing within the metering jet 21 from both the first air bleed passage 27 and the second air bleed passage 28, the amount of fuel fed into the intake passage 2 from the nozzle 23 is reduced and, thus, a lean air-fuel mixture is fed into the cylinder of the engine. In addition, at this time, since the vacuum chamber 15 is open to the atmosphere via the air conduit 33 and the air filter 35, the pressure in the vacuum chamber 15 becomes approximately equal to the atmospheric pressure. As a result of this, since the suction piston 3 moves toward the right in FIG. 1 as compared with the case wherein the level of vacuum in the vacuum chamber 15 is equal to that of vacuum in the venturi portion 8, the velocity of air flowing within the venturi portion 8** is increased and, thus the atomization of fuel is promoted. Therefore, even if a lean air-fuel mixture is fed into the cylinder of the engine, it is possible to obtain good combustion.

When the throttle valve 6 is opened approximately to its maximum extent, since the level of vacuum acting on the vacuum port 37 becomes small, the diaphragm 40 moves downward due to the spring force of the compression spring 45 and, thus, the movable contact **41*a* moves away from the stationary contact 41*b*. As a result of this, the valve body 32 of the electromagnetic control valve 31 shuts off the second air bleed passage 28, and the valve body 36 of the electromagnetic control valve 34 shuts off the air conduit 33**.

On the other hand, when the throttle valve 6 is rapidly opened from the position illustrated in FIG. 1, that is, at the time of acceleration, since the check valve 46 of the delay valve 39 remains closed, the level of vacuum in the second chamber 44 gradually becomes great. Consequently, since the second air bleed passage 28 remains shut off by the electromagnetic control valve 31 for a little while after the engine accelerating operation is started, the air-fuel mixture fed into the cylinder of the engine does not become lean during the acceleration and, thus, it is possible to obtain good engine accelerating operation.

Figure 2:
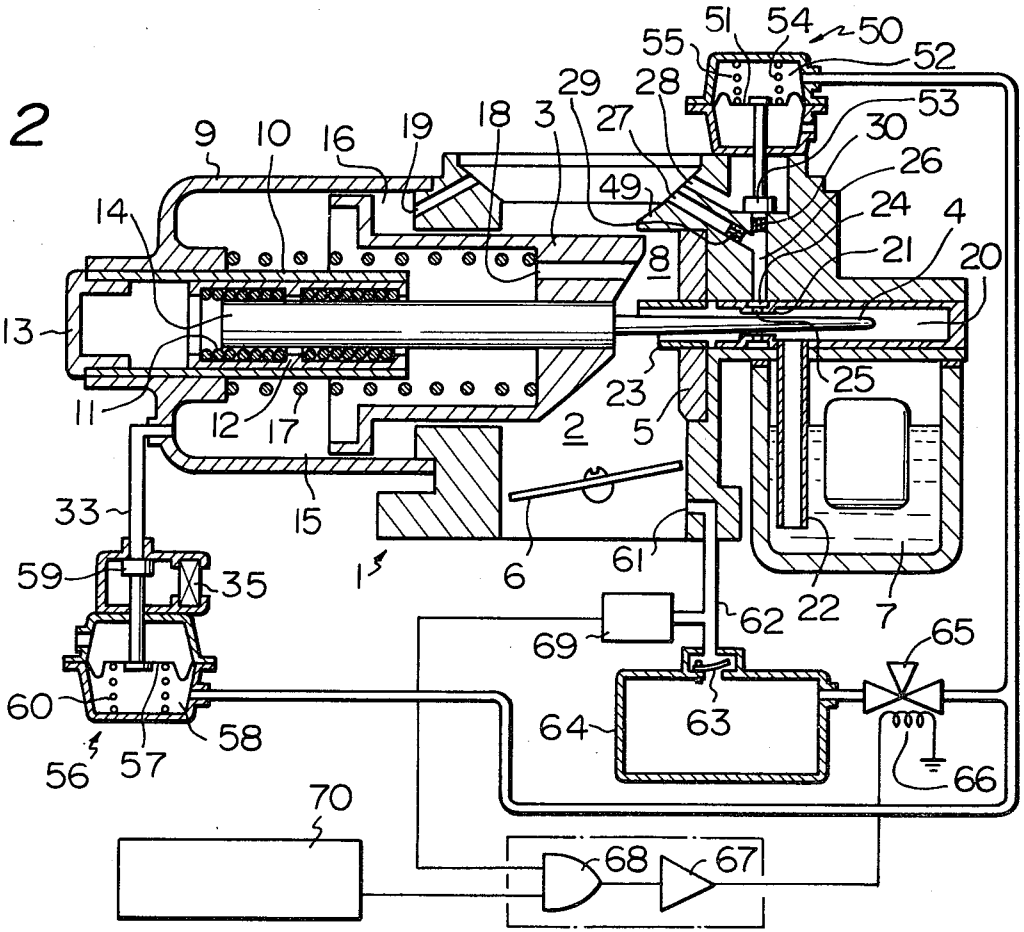
FIG. 2 is a cross-sectional side view of an alternative embodiment according to the present invention.

FIG. 2 illustrates an alternative embodiment. In this embodiment, a vacuum-operated diaphragm apparatus 50 is provided for controlling the opening operation of the second air bleed passage 28, and a vacuum-operated diaphragm apparatus 56 is provided for controlling the opening operation of the air conduit 33. The diaphragm apparatus 50 has therein a vacuum chamber 52 separated from the atmosphere by a diaphragm 51. A valve body 53, which serves to control the opening operation of the second air bleed passage 28, is connected to the diaphragm 51, and a compression spring 55 for biasing the diaphragm 51 is inserted into the vacuum chamber 52. On the other hand, the diaphragm apparatus 56 has a vacuum chamber 58 separated from the atmosphere by a diaphragm 57. A valve body 59, which serves to control the opening operation of the air conduit 33, is connected to the diaphragm 57, and a compression spring 60 for biasing the diaphragm 57 is inserted into the vacuum chamber 58. A vacuum port 61 is formed on the inner wall of the intake passage 2 located downstream of the throttle valve 6, and the vacuum port 61 is connected to a vacuum accumulation tank 64 via a vacuum conduit 62 and a check valve 63. The check valve 63 opens when the level of vacuum acting on the vacuum port 61 becomes greater than that of vacuum in the vacuum accumulation tank 64 and, thus, the interior of the vacuum accumulation tank 64 is maintained at a peak vacuum which has been produced in the intake passage 2. The vacuum accumulation tank 64 is connected to the vacuum chamber 52 of the diaphragm apparatus 50 and the vacuum chamber 58 of the diaphragm apparatus 56 via an electromagnetic control valve 65 which is able to open to the atmosphere. The solenoid 66 of the electromagnetic control valve 65 is connected to the output terminal of a power amplifier 67, and the input terminal of the power amplifier 67 is connected to the output terminal of an AND gate 68. One of the input terminals of the AND gate 68 is connected to a vacuum switch 69 which is operated in response to a change in vacuum acting on the vacuum port 61, and the other input terminal of the AND gate 68 is connected to a temperature reactive switch 70 which is operated in response to a change in the temperature of the engine cooling water. The vacuum switch 69 is turned to ON when the level of vacuum acting on the vacuum port 61 becomes smaller than a predetermined level, for example, −300 mmHg, and the temperature reactive switch 70 is turned to ON when the temperature of the engine cooling water becomes higher than a predetermined temperature, for example, 60° C.

When the temperature of the engine cooling water is lower than the predetermined temperature, or when the level of vacuum acting on the vacuum port 61 is greater than the predetermined level, the vacuum chamber 52 of the diaphragm apparatus 50 and the vacuum chamber 58 of the diaphragm apparatus 56 are open to the atmosphere via the electromagnetic control valve 65. Consequently, at this time, as illustrated in FIG. 2, the valve body 53 of the diaphragm apparatus 50 shuts off the second air bleed passage 28, and the valve body 59 of the diaphragm apparatus 56 shuts off the air conduit 33. On the other hand, when the temperature of the cooling water of the engine is higher than the predetermined temperature and when the level of vacuum acting on the vacuum port 61 is smaller than the predetermined level, the vacuum chamber 52 of the diaphragm apparatus 50 and the vacuum chamber 58 of the diaphragm apparatus 56 are connected to the vacuum accumulation tank 64 via the electromagnetic control valve 65. Consequently, at this time, since the valve body 53 of the diaphragm apparatus 50 opens the second air bleed passage 28, air is fed into the fuel passage 20 from both the first air bleed passage 27 and the second air bleed passage 28 and, thus, a lean air-fuel mixture is fed into the cylinder of the engine. In addition, at this time, since the valve body 59 of the diaphragm apparatus 56 opens the air conduit 33, the pressure in the vacuum chamber 15 becomes approximately equal to the atmospheric pressure. As a result of this, since the suction piston 3 moves toward the right in FIG. 2, the velocity of air flowing within the venturi portion 8 is increased and, thus, the atomization of fuel is promoted.

In the embodiments illustrated in FIGS. 1 and 2, the electromagnetic control valves 31, 34 and the diaphragm apparatus 50, 56 are controlled in response to a change in the degree of opening of the throttle valve 6 or in vacuum produced in the intake passage 2. However, instead of controlling the electromagnetic control valves 31, 34 and the diaphragm apparatus 50, 56 as mentioned above, the electromagnetic control valves 31, 34 and the diaphragm apparatus 50, 56 may be controlled in response to a change in the engine speed or in the amount of air fed into the cylinder of the engine.

According to the present invention, when the level of load of the engine is small, since the venturi portion has a large flow area, the flow resistance of the venturi portion is small. As a result of this, since air is fed into the cylinder of the engine in an amount which is sufficient for engine idling operation, it is possible to obtain stable engine idling operation. On the other hand, when the level of load of the engine is relatively high, since the velocity of air flowing within the venturi portion is increased, the atomization of fuel is promoted and, thus, it is possible to obtain stable combustion even if a lean air-fuel mixture is fed into the cylinder of the engine.

While the invention has been described with reference to specific embodiments chosen for purposes of illustration, it should be apparent that numerous modifications could be made thereto by those skilled in the art without departing from the basic concept and scope of the invention.

We claim:

1. A variable venturi-type carburetor comprising:

an intake passage formed in said carburetor and having an inner wall;

a casing having therein an interior chamber which extends perpendicular to said intake passage;

a suction piston movably inserted into said casing and having a tip face which projects into said intake passage and defines a venturi portion, said suction piston dividing the interior chamber of said casing into an atmospheric pressure chamber and a vacuum chamber which is connected to said venturi portion for moving said suction piston in response to a change in the amount of air flowing within said intake passage;

a throttle valve arranged in said intake passage located downstream of said suction piston;

a fuel passage having a metering jet therein and being open to said intake passage for feeding fuel into said intake passage;

a needle fixed onto the tip face of said suction piston and extending through said fuel passage and said metering jet;

an air bleed passage having an air inlet and an air outlet which is open to said fuel passage, said air inlet being open to the atmosphere;

an air feed passage having an air inlet and an air outlet which is open to said vacuum chamber, said air inlet being open to the atmosphere;

first valve means arranged in said air bleed passage for controlling the flow area of said air bleed passage;

second valve means arranged in said air feed passage for controlling the fluid connection between said vacuum chamber and the atmosphere; and means controlling said first valve means and said second valve means in response to a change in the level of load of an engine for reducing the flow area of said air bleed passage and shutting off said air feed passage when the level of load of the engine is lower than a predetermined level and for increasing the flow area of said air bleed passage and opening said air feed passage when the level of load of the engine is higher than the predetermined level.

2. A device according to claim 1, wherein said first valve means and said second valve means comprise a first electromagnetic control valve and a second electromagnetic control valve, respectively, said controlling means comprising a switch device for actuating said first electromagnetic control valve and said second electromagnetic control valve in response to a change in the level of vacuum produced in said intake passage.

3. A device according to claim 2, wherein said switch device has a vacuum port formed on the inner wall of said intake passage and being open to said intake passage located upstream of said throttle valve when the degree of opening of said throttle valve is smaller than a predetermined degree, said vacuum port being open to said intake passage located upstream of said throttle valve when the degree of opening of said throttle valve is larger than the predetermined degree, said switch device actuating said first electromagnetic control valve and said second electromagnetic control valve in response to a change in vacuum acting on said vacuum port for reducing the flow area of said air bleed passage and shutting off said air feed passage when the level of said vacuum is smaller than a predetermined vacuum level and for increasing the flow area of said air bleed passage and opening said air feed passage when the level of said vacuum is greater than the predetermined vacuum level.

4. A device according to claim 2, wherein said switch device comprises a control chamber connected to said intake passage via a vacuum passage, a diaphragm actuated in response to a change in the level of vacuum in said control chamber, and a switch connected to said diaphragm and controlling the energizing operation of said first electromagnetic control valve and said second electromagnetic control valve.

5. A device according to claim 4, wherein said switch device comprises a delay valve arranged in said vacuum passage for delaying the operation of said switch when said throttle valve is rapidly opened.

6. A device according to claim 5, wherein said delay device comprises a restricted opening and a check valve which are arranged in parallel in said vacuum passage.

7. A device according to claim 1, wherein said first valve means and said second valve means comprise a first diaphragm apparatus having a vacuum chamber and a second diaphragm apparatus having a vacuum chamber, respectively, said controlling means comprising an electromagnetic control valve for controlling the fluid connection between a vacuum source and the vacuum chamber of said first diaphragm apparatus and between the vacuum source and the vacuum chamber of said second diaphragm apparatus in response to a change in the level of vacuum produced in said intake passage.

8. A device according to claim 7, wherein said controlling means comprises a vacuum port which is open to said intake passage located downstream of said throttle valve, and a vacuum switch operated in response to a change in the level of vacuum acting on said vacuum port, said electromagnetic control valve being controlled by said vacuum switch for reducing the flow area of said air bleed passage and shutting off said air feed passage when the level of said vacuum is greater than a predetermined vacuum level and for increasing the flow area of said air bleed passage and opening said air feed passage when the level of said vacuum is smaller than the predetermined vacuum level.

9. A device according to claim 7, wherein said vacuum source is a vacuum accumulation tank connected to said intake passage via a check valve which allows only the outflow of air from said vacuum accumulation chamber to said intake passage.

10. A device according to claim 7, wherein said controlling means comprises a temperature reactive switch operated in response to a change in the temperature of the engine for reducing the flow area of said air bleed passage and shutting off said air feed passage when the engine temperature is lower than a predetermined temperature.

11. A device according to claim 1, wherein said air bleed passage comprises a plurality of air bleed passages and said first valve means is arranged in one of said air bleed passages.

12. A device according to claim 1, wherein the air outlet of said air bleed passage is formed on an inner circumferential wall of said metering jet.

13. A device according to claim 1, wherein a raised wall is formed on the inner wall of said intake passage, which faces the tip face of said suction piston, at a position located upstream of and adjacent to said suction piston, the tip face of said suction piston having an upstream end portion which cooperates with said raised wall for controlling the amount of air flowing within said venturi portion.

* * * * *